US006012239A

United States Patent [19]

Conway et al.

[11] Patent Number: 6,012,239

[45] **Date of Patent: *Jan. 11, 2000**

[54] REPLACEABLE TRACTION DEVICE FOR FOOTWEAR

[75] Inventors: Cyril J. Conway, Pittsford; John H. Schwartz, Honeoye Falls; Andrew W. Conway, Pittsford, all of N.Y.

[73] Assignee: Andrew W. Conway, Pittsford, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 09/079,782

[22] Filed: May 15, 1998

[51] Int. Cl.[7] ..... A43B 5/00; A43B 23/28; A43C 15/00

[52] U.S. Cl. ..... 36/134; 36/59 B; 36/62

[58] Field of Search ..... 36/59 R, 134, 36/59 B, 62, 67 D, 126, 127, 128, 129

[56] References Cited

U.S. PATENT DOCUMENTS

| | | | |
|---|---|---|---|
| D. 388,949 | 1/1998 | Savoie . | |
| 1,280,882 | 10/1918 | Simcoe | 36/59 B |
| 1,644,855 | 10/1927 | Packard | 36/59 R |
| 1,797,668 | 3/1931 | Morisse | 36/59 R |
| 1,918,279 | 7/1933 | Masterson | 36/67 B |
| 2,154,913 | 4/1939 | Nitkey . | |
| 2,302,471 | 11/1942 | Pierce et al. | 36/59 R |
| 2,607,134 | 8/1952 | Langer . | |
| 2,624,128 | 1/1953 | Phillips | 36/59 R |
| 2,911,738 | 11/1959 | Clerke . | |
| 3,054,197 | 9/1962 | Morgan et al. . | |
| 3,133,363 | 5/1964 | Phillips | 36/59 R |
| 3,267,593 | 8/1966 | Turner . | |
| 3,331,148 | 7/1967 | Hollister et al. . | |
| 3,566,489 | 3/1971 | Morley . | |
| 3,731,406 | 5/1973 | Young . | |
| 3,738,026 | 6/1973 | Granger . | |
| 3,760,514 | 9/1973 | Egtvedt . | |
| 3,810,341 | 5/1974 | Holz . | |
| 3,898,751 | 8/1975 | Gustin | 36/67 D |
| 3,911,600 | 10/1975 | Dassler . | |
| 4,035,934 | 7/1977 | Hrivnak . | |
| 4,262,434 | 4/1981 | Michelotti . | |
| 4,318,232 | 3/1982 | Ching | 36/59 B X |
| 4,357,763 | 11/1982 | Fleischmann et al. . | |
| 4,414,763 | 11/1983 | Bente . | |
| 4,445,288 | 5/1984 | Fror . | |
| 4,633,600 | 1/1987 | Dassler et al. . | |
| 4,667,422 | 5/1987 | Yamaguchi . | |
| 4,922,636 | 5/1990 | Chen . | |
| 5,025,576 | 6/1991 | Biasiotto et al. . | |
| 5,036,606 | 8/1991 | Erich et al. . | |
| 5,123,184 | 6/1992 | Ferreira . | |
| 5,197,210 | 3/1993 | Sink . | |
| 5,475,937 | 12/1995 | Korsen . | |
| 5,524,367 | 6/1996 | Ferreira et al. . | |
| 5,628,129 | 5/1997 | Kilgore et al. . | |
| 5,638,615 | 6/1997 | Korsen . | |
| 5,655,317 | 8/1997 | Grant | 36/134 |
| 5,782,017 | 7/1998 | Ortscheid | 36/134 |
| 5,848,482 | 12/1998 | Bathum | 36/127 |

OTHER PUBLICATIONS

ITW FASTEX Catalog, at least as early as May 1998, pp. 6,7, and 8, Century Fasteners Corp. Syracuse, New York, U.S.

RICHCO Catalog, 1997, pp. 69–80, Century Fasteners Corp., Edition 24, Syracuse, New York, U.S.

*Primary Examiner*—B. Dayoan
*Attorney, Agent, or Firm*—Cumpston & Shaw

[57] ABSTRACT

The present invention provides a traction device that is selectively removable from a threaded aperture and allows for the operative engagement of the traction device into a threaded aperture without requiring the rotation of the traction member relative to the threaded receptacle. The traction device includes a head and a shaft projecting from the head. The head may include any of a variety of ground engaging members such as wedges, spikes or teeth. A plurality of fins extend from the shaft and exhibit substantially equal flex resistance towards the head and away from the head. Upon operable engagement, the fins are biased between successive threads. The traction device may be configured to provide a substantially equal insertion force and extraction force.

36 Claims, 3 Drawing Sheets

REPLACEABLE TRACTION DEVICE FOR FOOTWEAR

FIELD OF THE INVENTION

The present invention relates to devices for improving the traction of footwear, and more particularly, to a readily replaceable traction member for footwear wherein the traction member may be inserted into and removed from a threaded aperture with generally equal forces without requiring rotation of the traction member.

BACKGROUND OF THE INVENTION

Traction members for footwear are generally known. The soles of footwear containing traction members usually contain a plurality of ground-engaging or gripping portions or members which may be permanent or may be removable and replaceable. The ground contacting portion of the traction members have been single or multiple spikes or various arrangements of protrusions within a single traction member. The ground contacting portion is often made of metal, rubber, polymer, or other material suited for the intended use. To retain the traction members containing these ground contacting portions within the soles of footwear, it is generally known to screw studs of light metal or synthetic polymer into threaded bores formed in the soles.

Although screw threaded traction devices are the most common, they are not without problems. The threads on the studs of traction members can become stripped and lose their attachment capabilities. Further, over-tightening of the stud may reduce the ability of the stud to be retained in the shoe. Also, removing threaded traction devices from threaded bores can be extremely time consuming. In addition, a threaded traction device screwed into a threaded bore can become partially unthreaded during a rotation of the footwear relative to the ground, and, when partially unthreaded, clumps of soil may become caught between the traction device and the sole of the footwear which can cause an imbalance in the wearer. If the traction device becomes unscrewed, the wearer may be unaware of the problem until the traction device falls off or until a large clump of soil stuck between the sole and traction device gains the attention of the wearer. Once the problem is identified, the wearer must interrupt play to find the traction device or a replacement device and to re-rotate the traction device and tighten it adequately within the bore. Furthermore, even with the growing popularity of "soft" spiked shoes, a special tool is still required for the installation and removal of the spikes. Thus, if the tool becomes misplaced, it can create problems for the wearer if a traction device needs removal or tightening.

The prior art discloses some efforts to solve the problems of screw threaded attachments, or to just devise a replacement for screw threaded attachments. Most of the prior art, however, would require a wearer to buy footwear fitted with soles having specially designed bores which could only fit accordingly specially designed traction devices. That is, a wearer would have to buy into a "system" of footwear and traction devices. Unless the system is hugely commercially successful, replacement traction devices would probably have to be specially ordered, which is inconvenient. Such a system could end up being quite costly since the wearer would have to buy new shoes and order replacement parts.

Thus, there is a need for traction devices which can be placed in screw threaded bores, found in most footwear which accommodate removable traction devices. There is a further need for such traction devices to be placed in screw threaded bores by using a method other than rotating. There is also a need for traction devices which can self insert upon application of pressure from the wearer's foot upon the ground. A further need exists for traction devices which can be easily removed when desired, but which do not compromise the attraction of the traction device within the bore in the sole. There is further a need for a traction device which meets the above-described needs and is, in addition, inexpensive to manufacture. There is further a need for a traction device having a shaft system which meets the above-described needs and which can utilize a head having any ground engaging means desired, such as a metal spike or polymer protrusions.

SUMMARY OF THE INVENTION

The present invention provides a traction device that is selectively engagable with a threaded receptacle or aperture. More particularly, the present traction device allows for the operative engagement of the traction device into a threaded aperture without requiring the rotation of the traction member relative to the threaded receptacle. In a preferred embodiment, the present traction device requires an insertion force to operatively engage the traction device with the threaded receptacle that is substantially equal to a retraction force required to disengage the traction device from the threaded receptacle. The present invention may be pushed into a threaded aperture and pulled from the aperture without requiring rotation and with generally equal forces.

Further, upon any unintended separation or working of the traction member from the threaded receptacle, upon the user placing a weight upon the given traction member, the traction member is forced back into the threaded receptacle.

In addition, the present invention provides the benefit of being able to readily remove the traction device without requiring threaded disengagement, which usually requires a separate tool. Although the present invention is configured for a push-pull insertion and removal, the design also precludes over-tightening of the traction device. That is, if a user were to rotate the present traction stud with respect to the threaded receptacle, upon exceeding a given resistance to rotation, the traction device exhibits a reduced resistance to rotation. Thus, the present invention permits a predetermined maximum retaining force.

The traction device generally includes a head having an outer face and at least one ground engaging protrusion extending from the outer face. A shaft projects from the head and includes a plurality of circumferentially spaced longitudinal ribs, the ribs encompassed by a periphery that lies within a periphery defined by the inner thread diameter of the receptacle. The traction device finally includes a plurality of parallel fins projecting from the shaft to extend beyond a portion of periphery defined by the inner thread diameter, and having an equal flex resistance in two directions along the ribs. The shaft, and traction device are retained within the threaded receptacle by the plurality of fins being biased between successive threads.

Other objects, features and advantages of the present invention will become apparent from the following detailed description of the preferred embodiment when taken in conjunction with the accompanying drawings.

DETAILED DESCRIPTION OF THE PREFERRED EMBODIMENTS

Figure 1:
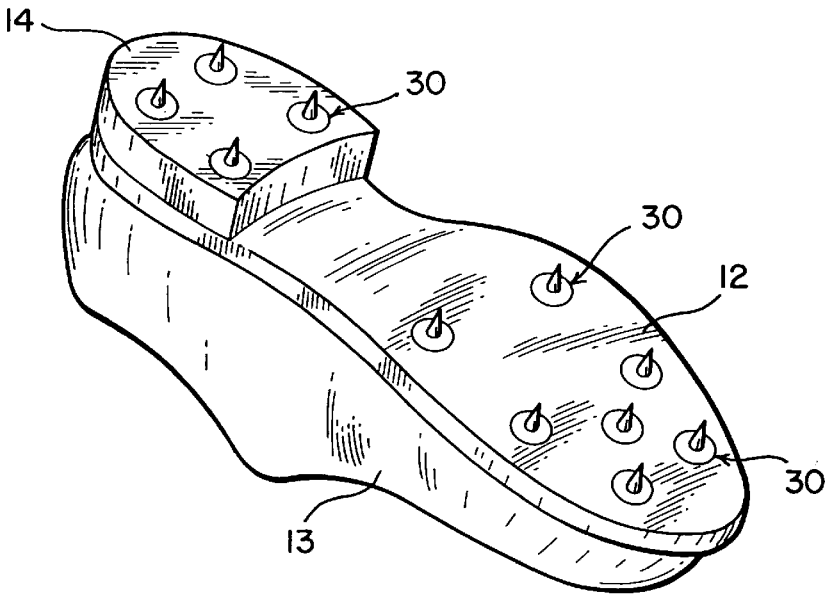
FIG. 1 is a perspective view of footwear having a plurality of operably retained traction devices.

Turning now to FIG. 1, a sole containing traction members according to one embodiment of the present invention is shown. The sole 12 is preferably attached to an upper 13 of footwear. The type of footwear containing the sole 12 of the present invention would typically be an athletic type of footwear such as would be useful when playing golf, football, baseball, soccer, or climbing terrain, but may also be useful for working outdoors or any other desired application. A heel 14 may be attached to the sole 12. Alternatively, the sole 12 may have a flat, integral heel, or no heel at all. While the sole 12 is shown as covering the entire lower surface of the upper 13, the sole 12 may instead be a skeletal type of sole which has the sole purpose of providing bores for traction members 30.

As an exemplary embodiment, a plurality of traction members 30 are shown which are distributed over the sole 12 and heel 14. It should be understood, of course, that any number of traction members 30 could be provided, and that their placement over the sole would vary depending on the intended application. The location of the traction members 30 may be regular, patterned or random. Also, the traction members 30 may include heads having a single centrally located spike for penetrating the ground. However, the heads of the traction members 30 of the present invention could encompass any number of ground engaging members as will be discussed.

Figure 2:
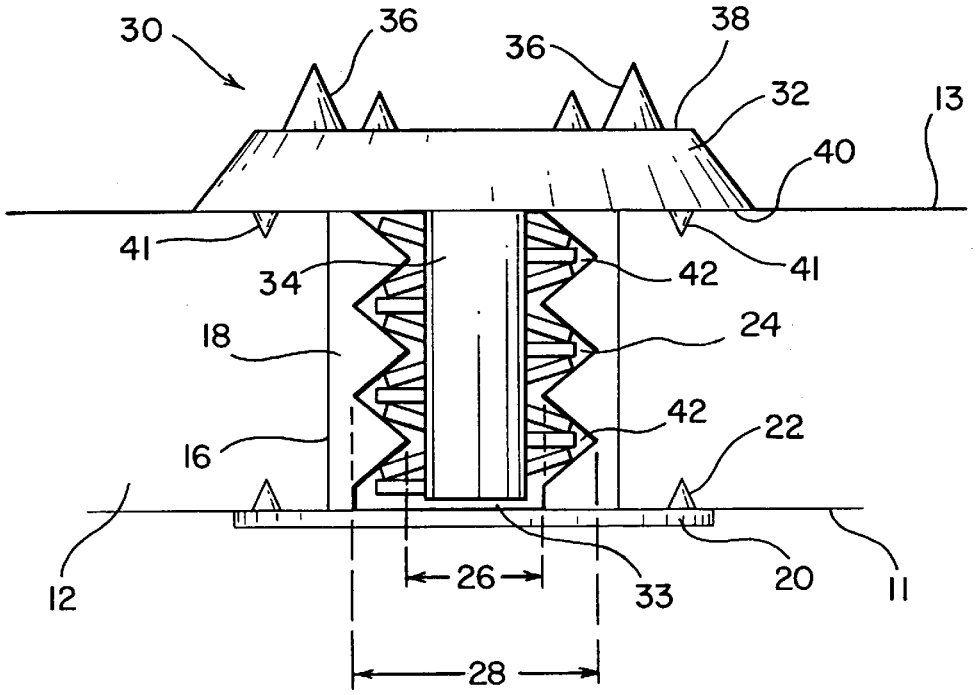
FIG. 2 is a cross sectional side elevational view of a traction device operably retained within a threaded aperture.

As shown in FIG. 2, the sole 12 is provided with a bore 16. The bore 16 may be threaded, or alternatively, a threaded insert 18 may be inserted within the bore 16. The threaded insert 18 is preferably made of metal for best retaining the integrity of its threads, but may be made of a hard plastic compound or other material capable of superior thread retention. The insert 18 may be retained within the sole by an overlapping plate 20 which would be positioned between an upper side 11 of the sole 12 and a lower side of the footwear's upper (not shown). The plate 20 may be secured to the sole 12 by protruding barbs 22. The threads 24 of the insert 18 or bore 16 define an inner thread diameter 26 and an outer thread diameter 28.

As further shown in FIG. 2, a traction member 30 may be inserted into a threaded bore 16 (not shown) or the threaded insert 18. The traction member 30 includes a head 32 and a shaft 34. The head 32 has an outer face 38 and an inner face 40. The outer face 38 of the head 32 preferably includes ground engaging members 36 which protrude from the outer face 38. As shown, the ground engaging members 36 are pointed protrusions which extend above the plane or surface of the outer face 38, and which may be positioned at any location on the outer face 38. In addition, the ground engaging members 36 may include a central portion or spike, substantially colinear with the shaft 34. In one configuration, the ground engaging members 36 may be located along the periphery of the outer face 38. Other exemplary embodiments will be shown, and it should be noted that any shape and configuration of the protrusions is within the scope of this invention.

Figure 3:
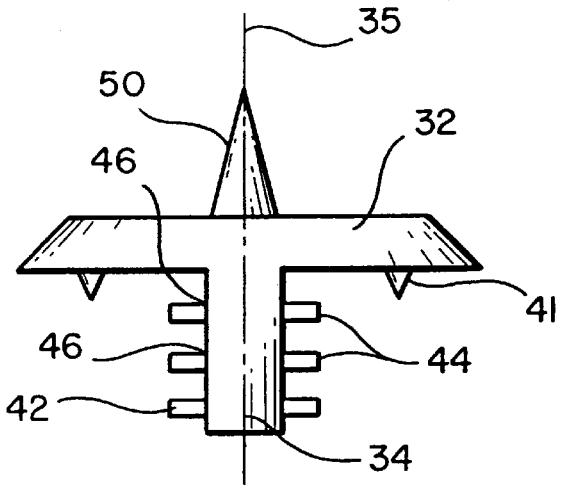
FIG. 3 is a side elevational view of a configuration of the traction device.
Figure 4:
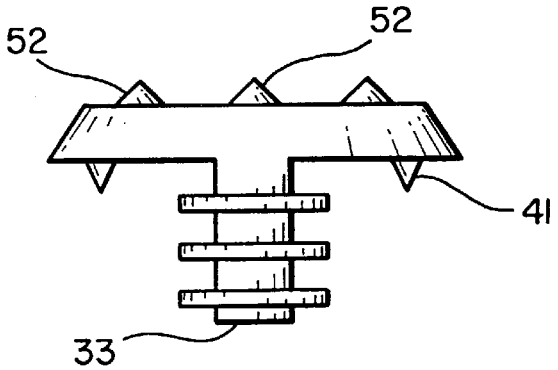
FIG. 4 is a side elevational view of an alternative configuration of the traction device.

Turning to FIGS. 3 and 4, two different types of ground engaging protrusions are shown. FIG. 3 shows a single spike 50, embedded or incorporated in the shaft. The spike 50 may extend beyond the head 32. The spike 50 may be any of a variety of materials, but is preferably made of metal. FIG. 4 shows a plurality of protrusions 52 which are evenly distributed across the outer face 38 of the head 32, including a central area of the outer face 38. The inner face 40 is adapted to lie substantially flush with the lower side 13 of the sole 12 adjacent the bore 16. Although the inner face 40 and outer face 38 are shown as planar, either face could be curved.

Referring to FIGS. 2, 3 and 4, the inner face 40 may include at least one rotation preventing projection 41. Preferably, the rotation preventing projection has a sufficient penetrating edge or surface and size to at least partially embed in the footwear adjacent the threaded aperture. Upon embedding in the footwear, the rotation preventing projection reduces or precludes rotation of the traction member 30 relative to the footwear. Although the rotation preventing projection may be of a variety of shapes or configurations, the present embodiment includes four sided pyramids. By reducing the tendency of the traction member 30 relative to the threaded aperture, the rotation preventing projections reduce the tendency of the traction member to rotate from the threaded aperture.

The shaft 34 preferably extends from a central area of the inner face 40 of the head 32, although it is possible for the shaft 34 to extend from a non-central area as well. The shaft 34 preferably extends a distance substantially equal to the length of the bore 16. The shaft 34 has a proximal end adjacent the head 32 and a distal end 33 spaced from the head. Of course, if the inner face 40 is slightly concave, than the shaft 34 may be slightly longer than the length of the bore 16 to compensate for the depth of the concavity. Also, it is preferred, the shaft 34 extend a substantial length of the bore 16, without having a length greater than the bore. Thus, the shaft is sized to substantially preclude the shaft from "bottoming out" on the bottom of the bore.

With reference to FIG. 2, and turning to FIGS. 3 and 4, the traction member 30 further includes a plurality of fins 42 which extend from the shaft 34. The fins 42 are parallel to each other and in a preferred configuration extend substantially perpendicular to the axis of the shaft 34. However, it is understood the fins 42 may be inclined or non perpendicular to the axis of the shaft 34 and/or have a varying thickness that permits the fin 42 to flex along the longitudinal axis of the shaft 34 in a direction toward the head 32 and away from the head with substantially equal degrees of resistance. That is, the fins 42 flex towards and away from the footwear with substantially equal degrees of freedom and resistance. That is, an insertion force, required to seat the traction member in a threaded aperture without rotation relative to the threaded aperture, and an extraction force required to pull the traction member from the threaded aperture without rotation relative to the threaded aperture are substantially equal. Further, as discussed herein, the fins 42 may be non parallel so long as the insertion force substantially equals the extraction force, without requiring rotation of the shaft. However, it is understood the fins 42 can be configured to provide an insertion force that is greater than or less than the extraction force. For example, the fin configuration and orientation with respect to the shaft 34 may be selected to provide a greater extraction force than the insertion force.

As shown in FIG. 2, the fins 42 define a periphery which extends at least once, beyond the periphery of the inner thread diameter 26. Preferably, the fins 42 extend less than the outer thread diameter 28. That is, it is critical that a portion of the fin periphery extend beyond the periphery of the inner thread diameter. However, it is not necessary that the fins entire periphery be greater than the inner thread periphery. The fins 42 are preferably made of a plastic material such as Nylon 6/6, or other material which enables the fins 42 to bend relative to the shaft 34 in response to the insertion force and the extraction force. As shown in FIG. 2, the fins 42 are flexed in both directions along the longitudinal axis of the shaft 34. In the configuration having the fins extending perpendicular to the shaft, each fin 42 preferably has a uniform thickness from the peripheral edge 44 of the fin 42 to the edge 46 of the fin 42 attached to the shaft 34. The uniform thickness allows the fin 42 to bend an equal distance towards the head 32 and away from the head 32. The fins 42 thus have an equal flex resistance in two direction along the shaft 34. The fins 42 extend from the shaft along substantially the entire length of the shaft 34. Preferably, a fin 42 projects from the shaft 34 adjacent the distal end 33.

Figure 5:
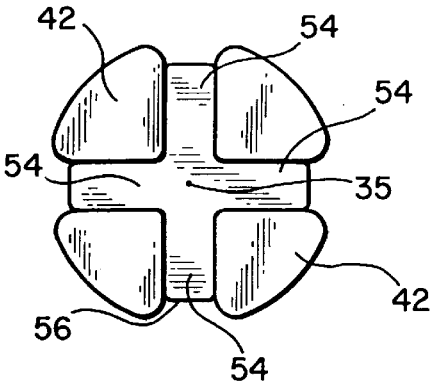
FIG. 5 is a cross sectional view of a shaft of the present invention.
Figure 6:
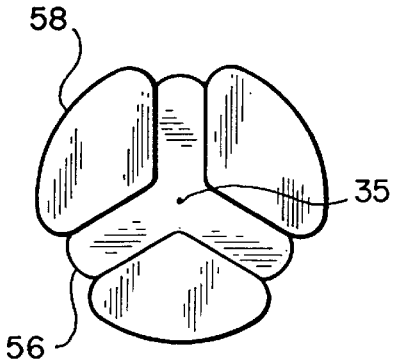
FIG. 6 is a cross sectional view of a shaft of an alternative configuration of the present invention.
Figure 7:
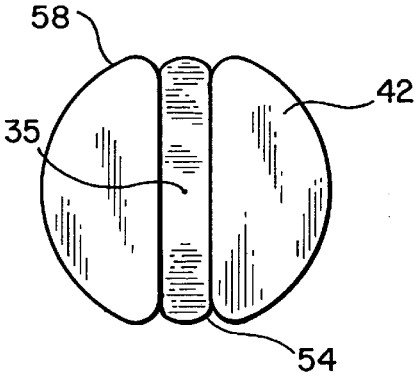
FIG. 7 is a cross sectional view of a shaft of a further alternative configuration of the present invention.
Figure 8:
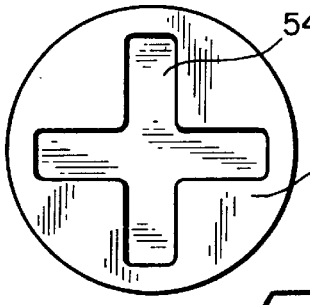
FIG. 8 is a cross sectional view of a shaft of a further alternative configuration of the present invention.
Figure 9:
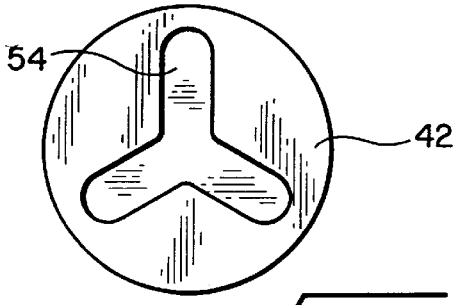
FIG. 9 is a cross sectional view of a shaft of a further alternative configuration of the present invention.
Figure 10:
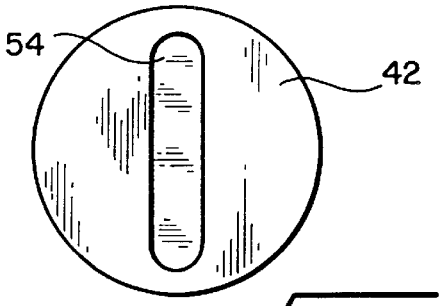
FIG. 10 is a cross sectional view of a shaft of a further alternative configuration of the present invention.
Figure 11:
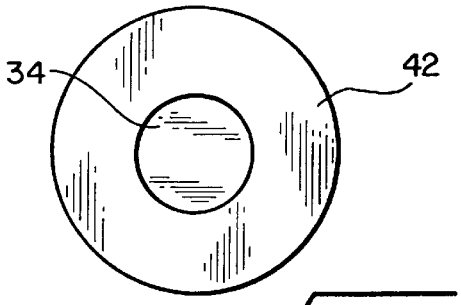
FIG. 11 is a cross sectional view of a shaft of a further alternative configuration of the present invention.

Because the fins 42 are bendable in either direction along the longitudinal axis of the shaft 34, it may be desirable in some embodiments to provide longitudinal ribs 54 between the fins so as to prevent them from being too flimsy. As shown in FIGS. 5–7, the shaft 34 may include longitudinal ribs 54. FIG. 5 shows four ribs 54 extending in radially opposite directions from the longitudinal axis 35 of the shaft 34, The longitudinal axis 35 is shown as a dot in FIGS. 5–7. Referring to FIG. 5, the periphery of the fin 42 falling within a single plane may thus be divided into four fin sections as shown. Likewise, FIG. 6 shows three ribs 54 and three fins 42. FIG. 7 shows one long rib 54 (or two opposed ribs 54 extending from the shaft's longitudinal axis 35), and two fins 42. The longitudinal ribs 54 preferably extend from proximal end of the shaft 34 at the inner face 40 of the head 32 to the distal end 33. The ribs 54 are preferably substantially nondeformable so as to provide strength to the fins 42. Also, the outermost peripheral edges 56 of the ribs 54 are located within the inner thread diameter 26 of the threads 24. The fins 42 which extend between the ribs 54 define, at least at their outermost peripheral edges 58, a periphery which crosses the periphery defined by the inner thread diameter 26. Preferably, the periphery defined by the fins 42 terminates within the periphery defined by the outer thread diameter 28.

In a preferred configuration, the fins 42 and the ribs 54 are selected such that a given fin has portions that extends from rib to rib. That is, the periphery of the fin 42 projects beyond the circumference of the inner thread diameter between two circumferentially spaced ribs 54. Thus, if the shaft 34 includes four ribs 54, a periphery of a fin projects beyond the circumference of the inner thread diameter at four separate locations. Similarly, if the shaft 34 includes three ribs 54, a periphery of a fin layer projects beyond the circumference of the inner thread diameter at three separate locations. FIGS. 8–11 show how the peripheral edges 58 of the fins may extend beyond all the peripheral edges of the ribs 54 such that at least a majority of the peripheral edges 58 extends beyond the inner thread diameter 26.

In the preferred configuration, the ribs 54 are sized to be located just within the circumference defined by the inner thread diameter 26. When the ribs 54 are located just within the circumference defined by the inner thread diameter 26, the support and stability of the ribs, shaft 34 and hence traction member 30 is readily conveyed to the shoe and hence user.

When it is desired to insert a traction member 30 into a bore 16, the user need only align the shaft 34 with the bore 16 and apply a pressure to the head 32 to push the shaft 34 to the end of the bore 16 or threaded insert 18. Rotation of the traction member 30 relative to the threaded bore is not required. The pressure may come from a person's finger pushing on the outer face 38 of the head 32. Alternatively, the pressure may come from an application of force to the outer face 38 via a person's foot stepping on the upper side 11 of the sole 12. Of course, a small hammer or other tool may be used. The traction member 30 is thus very simple to insert and requires less time to insert than a traction member with a threaded shaft.

As the traction member 30 is inserted into a threaded bore, whether it be a threaded bore 16 or threaded insert 18, the fins 42 initially bend towards the head 32. Once a periphery of a fin 42 passes a crown of the thread, the fin may assume its unbiased position substantially perpendicular to the longitudinal axis of the shaft 34. Once the traction member 30 is fully inserted into the bore, the fins 42 bend as necessary as shown in FIG. 2 to fit within the threads. Some of the fins 42 may bend towards the head 32, some of the sides of the fins 42 may bend away from the head 32, and some of the fins 42 may assume their biased position of being perpendicular to the longitudinal axis of the shaft 34. A single fin 42 may have some of its periphery bent and some of its periphery in its biased position, depending on where the fin 42 falls within a thread.

After all traction members 30 have been inserted into the sole 12, a wearer of the footwear 10 need not worry about the traction members 30 becoming disengaged, such as by unthreading, from the bores 16. If a traction member 30, for some reason, starts to disengage with the threads 24, a wearer's next step will apply a force to the upper side 11 of the sole 12 which will force the fins 42 of the shaft 34 back into the threads 24. Thus, every step the wearer takes will insure that the traction members 30 are fully inserted into the bores 16.

When it comes time to remove the traction members 30 from the sole 12, such as for exchanging the traction members from a metal spike to a less ground damaging alternative tread pattern, the traction members 30 may be easily removed by merely pulling the traction members 30 from the sole 12. A tool for inserting between the inner face 40 of the head 32 and the lower side 13 of the sole 12 may be used to lever the traction member 30 out of the bore 16. However, a person's own fingers would be adequate for removing the traction members 30. For those traction members 30 selected to have substantially equal insertion and extraction forces, the force required to remove the traction members is substantially equal to the force required to insert the traction members into the bores 16. Again, because each traction member 30 need not be unscrewed from the bores 16 and because relatively little force is required to remove the traction members 30 from the sole 12, removal of the traction members 30 from the sole 12 requires very little time and effort.

The present invention is capable of utilizing any tread pattern of protrusions, including protrusions which extend from a central area of the head 32 because it is not necessary to insert and secure the traction member 30 by the central area. A person may push the traction member 30 along any area of the outer surface 38, simply step on the footwear once the shaft 34 has been aligned with the threaded receptacle, or hammer on the head 32. Thus, the traction member 30 of the present invention is capable of utilizing any tread pattern necessary for an application, as the insertion methods can be easily accommodated.

The foregoing description of the preferred embodiment of the invention has been presented for purposes of illustration and description. It is not intended to be exhaustive or to limit the invention to the precise form disclosed, and many modifications and variations are possible in light of the above teaching. The preferred embodiment was chosen and described in order to best explain the principles of the invention and its practical applications to thereby enable others skilled in the art to best utilize the invention and various embodiments and with various modifications as are suited to the particular use contemplated. It is intended that the scope of the invention be defined only by the claims appended hereto.

What is claimed is:

1. A traction member for releasably engaging a threaded aperture in a shoe, the threaded aperture having an inner thread diameter and an outer thread diameter, the traction member comprising:

(a) a head having an outer face and at least one ground engaging protrusion extending from the outer face, the ground engaging protrusion adapted to engage the ground;

(b) an elongate shaft projecting from the head, the shaft including a longitudinal rib, the rib encompassed by a periphery that lies entirely within a periphery defined by the inner thread diameter; and (c) a plurality of fins projecting from the shaft to have a portion extend beyond a portion of the periphery defined by the inner thread diameter, and having an equal flex resistance in two directions along the longitudinal rib.

2. The traction member of claim 1, wherein the rib does not deform.

3. The traction member of claim 1, wherein there are four ribs.

4. The traction member of claim 1, wherein the fins of a given plane extend beyond the inner thread diameter at two spaced locations.

5. The traction member of claim 1, wherein the fins of a given plane extend beyond the inner thread diameter in four spaced locations.

6. The traction member of claim 1, wherein the fins are planar.

7. The traction member of claim 1, wherein an intersection of the rib and the fins lies in a common plane.

8. The traction member of claim 1, wherein the fins of a given plane define a fin layer having a continuous periphery.

9. The traction member of claim 1, wherein the shaft and head are integral.

10. The traction member of claim 1, wherein the head has a plurality of ground engaging protrusions.

11. The traction member of claim 10, wherein the plurality of ground engaging protrusions are evenly distributed across the outer face.

12. The traction member of claim 11, wherein the at least one ground engaging protrusion is located within a central area of the head.

13. The traction member of claim 1, wherein the at least one ground engaging protrusion is a metal spike.

14. The traction member of claim 13, wherein the metal spike lies along a longitudinal axis common with the shaft.

15. The traction member of claim 1, wherein the shaft has a proximal end adjacent the head and a spaced apart distal end, wherein fins project adjacent the distal end.

16. The traction member of claim 1, wherein the traction member is a one piece unit.

17. The traction member of claim 15, wherein the rib extends to the distal end.

18. The traction member of claim 1, wherein the head comprises an inner face on the side where the shaft projects, the inner face provided with a plurality of protrusions.

19. The traction member of claim 1, further comprising at least two longitudinal ribs.

20. A sole adapted for athletic footwear, the sole comprising:

(a) a plurality of screw threaded apertures, each aperture having an inner thread diameter and an outer thread diameter; and (b) a plurality of traction members removably insertable within the threaded apertures, the traction members insertable within the aperture by using a non-rotating insertion force, and removable from the aperture by using a non-rotating extraction force.

21. The sole of claim 20, wherein the sole comprises an upper surface and a lower surface, the traction members adapted for attachment to the lower surface of the sole, and wherein a traction member which is partially inserted within an aperture in the sole may be fully inserted by applying a downward force to the upper surface of the sole.

22. The sole of claim 20, wherein each traction member comprises:

(i) a head having an inner face adapted to lie adjacent a portion of the sole; and (ii) a shaft projecting from the inner face and defining a shaft axis, the shaft including a plurality of parallel fins projecting from the shaft.

23. The sole of claim 22, wherein the fins lying in a common plane have a periphery portion that extends beyond the inner thread diameter and less than the outer thread diameter.

24. The sole of claim 22, wherein the fins have a substantially equal flex resistance in two directions along the shaft axis.

25. The sole of claim 22 wherein the head has an outer face, the outer face provided with at least one ground engaging protrusion adapted to contact the ground.

26. The sole of claim 25, wherein the at least one protrusion is a plurality of radially arranged projections.

27. The sole of claim 26, wherein the projections are non-metal.

28. The sole of claim 25, wherein the at least one protrusion is a spike having a longitudinal axis lying along the shaft axis.

29. The sole of claim 28, wherein the spike is metal.

30. The sole of claim 23, wherein the periphery is continuous.

31. A traction member for releasably engaging a threaded aperture in a shoe, the threaded aperture having an inner thread diameter and an outer thread diameter, the traction member, comprising:

(a) a head including a ground-engaging surface; and (b) a shaft projecting from the head, the shaft having a longitudinal axis and including a plurality of fins projecting from the longitudinal axis, the fins defining a periphery having a portion greater than the inner thread diameter, and the fins having an insertion force and extraction force, the shaft having a proximal end adjacent the head and a distal end spaced from the head, wherein at least one fin projects from the shaft adjacent the distal end.

32. The traction member of claim 31, wherein the head further includes a plurality of ground engaging members.

33. The traction member of claim 31, wherein the insertion force is substantially equal to the extraction force.

34. The traction member of claim 31, wherein the insertion force is greater than the extraction force.

35. The traction member of claim 31, wherein the insertion force is less than the extraction force.

36. A method of releasably attaching a traction member to footwear, comprising:

(a) non rotationally engaging a plurality of fins located on a shaft of the traction member with a threaded receptacle on the footwear, and (b) non rotationally and non destructively disengaging the plurality of fins from the threaded receptacle.

* * * * *

UNITED STATES PATENT AND TRADEMARK OFFICE

CERTIFICATE OF CORRECTION

PATENT NO. : 6,012,239

DATED : January 11, 2000

INVENTOR(S) : Conway, et al.

It is certified that error appears in the above-indentified patent and that said Letters Patent is hereby corrected as shown below:

On the title page, item [56],
Under reference cited, other publications, add -- Smart Spikes Smart Lock trademark sheet, at least as early as May 15, 1998 --

Signed and Sealed this

Twelfth Day of December, 2000

*Attest:*

Q. TODD DICKINSON

*Attesting Officer*

*Director of Patents and Trademarks*